US009102149B2

(12) United States Patent
Nagai et al.

(10) Patent No.: US 9,102,149 B2
(45) Date of Patent: Aug. 11, 2015

(54) LIQUID EJECTION HEAD

(71) Applicant: CANON KABUSHIKI KAISHA, Tokyo (JP)

(72) Inventors: Masataka Nagai, Yokohama (JP); Yoshinori Tagawa, Yokohama (JP); Toshiaki Kurosu, Oita (JP); Hiroyuki Murayama, Yokohama (JP); Makoto Watanabe, Yokohama (JP); Takanobu Manabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/310,400

(22) Filed: Jun. 20, 2014

(65) Prior Publication Data

US 2015/0002583 A1 Jan. 1, 2015

(30) Foreign Application Priority Data

Jun. 28, 2013 (JP) ..... 2013-136629

(51) Int. Cl.
*B41J 2/14* (2006.01)

(52) U.S. Cl.
CPC ..... *B41J 2/1433* (2013.01); *B41J 2002/14387* (2013.01); *B41J 2002/14475* (2013.01); *B41J 2202/03* (2013.01); *Y10T 29/49401* (2015.01)

(58) Field of Classification Search
CPC ..... B41J 2202/19; B41J 2/1433; B41J 2/145; B41J 2002/14475; B41J 2/16
USPC ..... 347/40, 45, 47, 54, 56, 65; 430/320
See application file for complete search history.

(56) References Cited

U.S. PATENT DOCUMENTS 8,029,860 B2 * 10/2011 Kobayashi ..... 427/264
2009/0162797 A1 6/2009 Tsuji et al.

FOREIGN PATENT DOCUMENTS

JP 2009-166492 A 7/2009

* cited by examiner

*Primary Examiner* — An Do
(74) *Attorney, Agent, or Firm* — Fitzpatrick, Cella, Harper & Scinto

(57) ABSTRACT

A liquid ejection head is provided with a recording element substrate having a plurality of ejection orifices for ejecting a liquid, the plurality of ejection orifices being arranged to form a row of the ejection orifices. In at least some of the plurality of the ejection orifices, each having one side and another side, the area of an inner wall of the ejection orifices is set to be larger on the other side than on the one side, the one side and the other side being defined by a plane which passes through the center of the ejection orifice, intersects with the row of the ejection orifices at right angles and extends along the direction of the depth of the ejection orifice.

8 Claims, 9 Drawing Sheets

LIQUID EJECTION HEAD

BACKGROUND OF THE INVENTION

1. Field of the Invention

The present invention relates to a liquid ejection head that carries out a recording operation by ejecting a liquid.

2. Description of the Related Art

As an example of a method for carrying out recording by using a liquid ejection head that ejects a liquid, there is an ink-jet recording method in which recording is carried out by ejecting a liquid, e.g. an ink, onto a recording medium. As an example of the method for fabricating a liquid ejection head, a method using a reduced projection type i-ray exposure device has been disclosed in Japanese Patent Application Laid-Open No. 2009-166492.

The liquid ejection head disclosed in Japanese Patent Application Laid-Open No. 2009-166492 includes a substrate that has energy generating elements, which generate ejection energy used to eject liquids through ejection orifices, an ejection orifice member provided with the ejection orifices, and a flow path, which is formed by the substrate and the ejection orifice member and which is in communication with the ejection orifices. To fabricate the liquid ejection head, a positive type photosensitive resin layer is deposited on the substrate that has the energy generating elements. Then, the positive type photosensitive resin layer is exposed to form a pattern of the liquid flow path. Subsequently, a negative type photosensitive resin layer, which will provide the ejection orifice member, is deposited on the pattern. Subsequently, the negative type photosensitive resin layer is exposed by using an i-ray, pre-baked and developed, thereby forming the ejection orifices. This procedure makes it possible to easily obtain with high repeatability extremely good circular ejection orifices.

SUMMARY OF THE INVENTION

In the liquid ejection head in accordance with the present invention which is provided with a recording element substrate having a plurality of ejection orifices for ejecting a liquid, the plurality of the ejection orifices are arranged to form a row of the ejection orifices. In at least some of the plurality of ejection orifices, the area of the inner wall of each ejection orifice is set to be larger on the other side than on one side, the other side and the one side being defined by a plane that passes through the center of the ejection orifice, orthogonally intersects with the row of the ejection orifices, and extends along the direction of the depth of the ejection orifice.

Further features of the present invention will become apparent from the following description of exemplary embodiments with reference to the attached drawings.

DESCRIPTION OF THE EMBODIMENTS

Figure 1A:
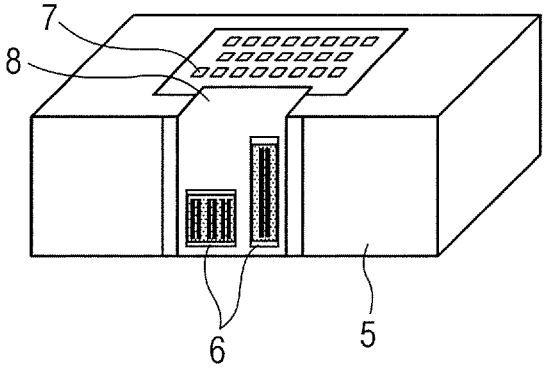
FIGS. 1A and 1B are schematic configuration diagrams of an embodiment of a liquid ejection head in accordance with the present invention.

Preferred embodiments of the present invention will now be described in detail in accordance with the accompanying drawings. Components having like functions will be assigned like reference numerals in the accompanying drawings and the descriptions thereof will be omitted in some cases.

According to the fabrication method disclosed in Japanese Patent Application Laid-Open No. 2009-166492, i-ray exposure is carried out on a negative type photosensitive resin layer by a reduced projection exposure device when forming ejection orifices. The reduced projection exposure device is provided with a reduced projection optical system. At the time of the exposure through the reduced projection optical system, the negative type photosensitive resin layer is subjected to telecentricity attributable to the reduced projection optical system. The term "telecentricity" means the property of light traveling in a straight line. The light passing through the reduced projection optical system advances to be focused on the center of an optical axis. Hence, the light is irradiated to an object perpendicularly at the center of an exposure angle of view, while irradiated at an angle relative to perpendicularity toward an outer periphery of the exposure angle of view, i.e., the light is irradiated aslant to the object.

Figure 10A:
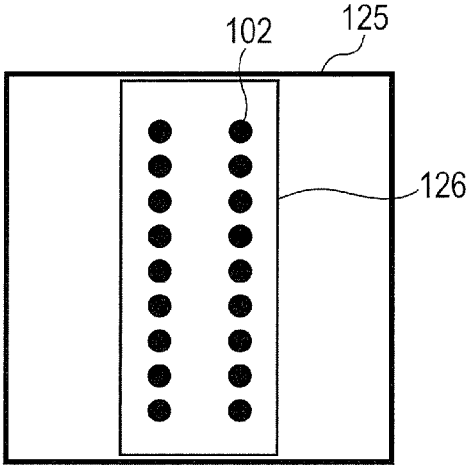
FIGS. 10A and 10B are diagrams illustrating the influence of telecentricity when an ejection orifice pattern region is exposed.
Figure 10B:
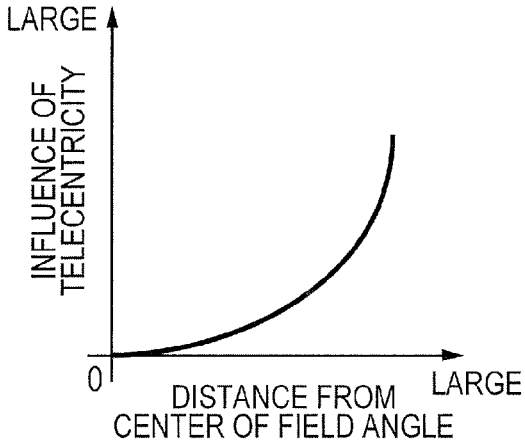

More specifically, if a pattern region 126 of ejection orifices 102 is exposed at an exposure field angle 125, as illustrated in FIG. 10A, then different influences of telecentricity are exerted, depending on the positions of the ejection orifices 102, as illustrated in FIG. 10B. FIG. 10B illustrates the relationship between the distance of each ejection orifice from the center of the field angle and the influence of the telecentricity. At the position of the center of the field angle, the light is irradiated perpendicularly to the negative type photosensitive resin layer, whereas the light is irradiated at a greater angle relative to the perpendicularity as the distance from the center of the field angle increases. For this reason, the ejection orifices formed in the vicinity of the center of the field angle are perpendicular to the surface of the negative type photosensitive resin layer, whereas the ejection orifices formed at positions apart from the center of the field angle are formed at angles relative to the surface of the negative type photosensitive resin layer.

Figure 11B:
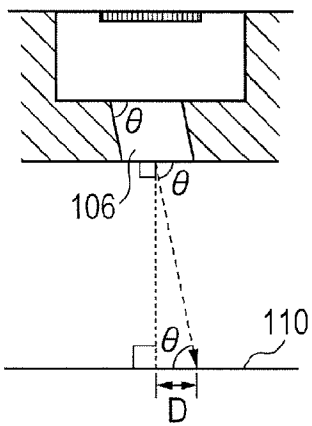
FIGS. 11A and 11B are schematic diagrams illustrating how a liquid is ejected through an ejection orifice subjected to telecentricity.
Figure 11A:
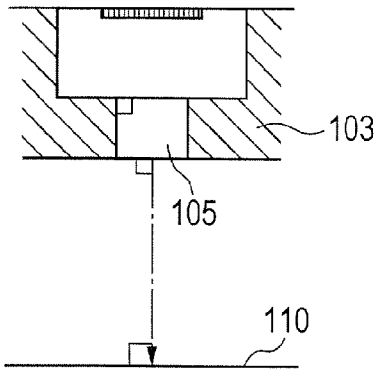

Therefore, as illustrated in FIG. 11A, the ejection direction of a liquid from an ejection orifice 105 formed at the center of the field angle is ideally 90° relative to the surface of an ejection orifice member 103. On the other hand, an ejection orifice 106 located away from the center of the field angle is formed at an angle θ (excluding 90°) relative to the surface of the ejection orifice member 103, i.e., formed aslant. As illustrated in FIG. 11B, therefore, the ejection direction of the liquid is not perpendicular to a recording medium 110 and is an inclined direction. This results in a difference D between an ideal impact position and an actual impact position.

Figure 12:
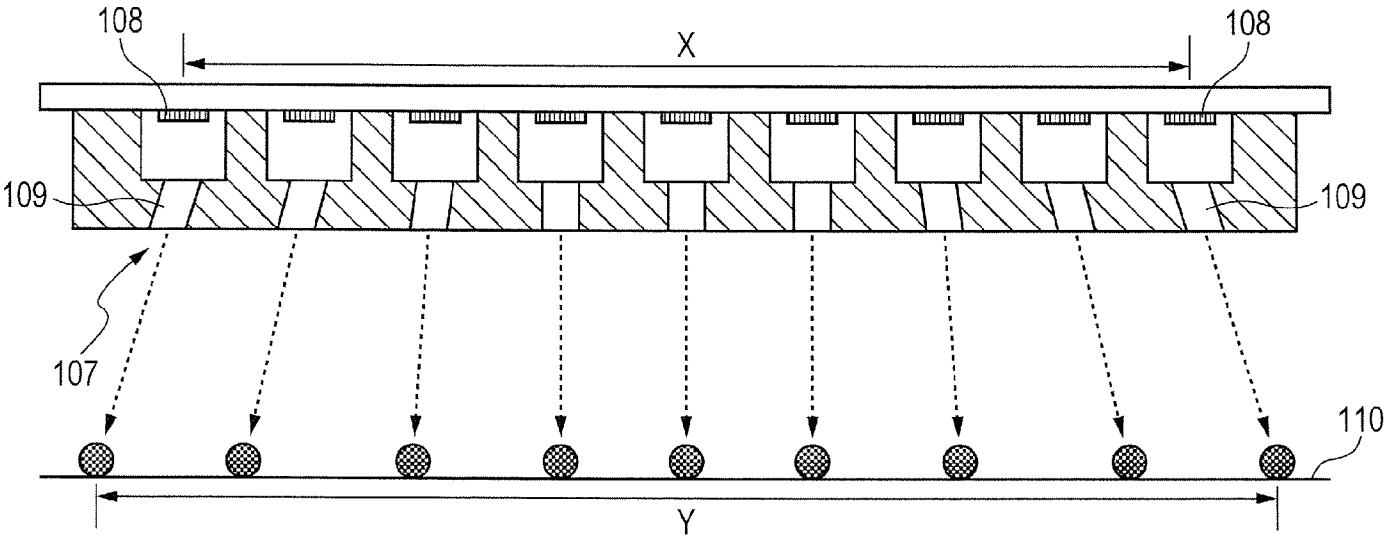
FIG. 12 is a diagram illustrating the impact positions of droplets ejected from an ejection orifice row having the ejection orifices thereof subjected to telecentricity.

Thus, if the reduced projection exposure device is used, then an interval Y between the impact positions of liquids ejected from ejection orifices 109 positioned at both ends of an ejection orifice row 107 will be larger than an interval X between heaters 108 corresponding to both ends of the ejection orifice row 107, as illustrated by the ejection orifice row 107 in FIG. 12. Further, the intervals among the impact positions will not be equal.

If an ink-jet recording head having the aforesaid ejection orifices is scanned a plurality of times to form an image by ejecting liquids onto a recording medium, then a deviated impact takes place in the vicinity of the boundary of adjoining scan regions. The term "deviated impact" means the deviation of an impact position out of a scan region from an ideal impact position, which is caused by the inclinations of the ejection orifices on both ends of an ejection orifice row. The deviated impact causes overlapped droplets in the vicinity of a boundary, so that a streak of a dark color region occurs, resulting in a deteriorated recording quality. As a solution to the deviated impacts, there is a method for correcting the travel amount of a recording medium to prevent scan regions from overlapping. However, in the case of an ejection orifice subjected to the influence of the telecentricity, the impact position of each ejection portion will be uneven in the same ejection row. This correction method, therefore, inconveniently causes irregular recording in a scan region.

An object of the present invention is to provide a liquid ejection head that restrains impact positional displacement attributable to the influence of telecentricity, thereby leading to higher image quality.

The liquid ejection head in accordance with the present invention can be installed in a device, such as a printer, a copying machine, a facsimile machine having a communication system, and a word processor incorporating a printing unit, or an industrial recording device or the like compositely combined with various types of processing devices. By using the liquid ejection head, recording can be carried out on a variety of recording media, including paper, thread, fiber, leather, metal, plastics, glass, wood, and ceramics.

The term "recording" used in the present description will mean not only to impart characters, figures or the like on recording media but also to impart images that do not have meanings, such as patterns.

Further, the term "liquid" should be broadly construed and should refer to a liquid served to form an image, a design, a pattern or the like by being imparted onto a recording medium, to process a recording medium, or to treat a recording medium. In this case, the treatment of a recording medium refers to, for example, the improvement of fixity by coagulation or insolubilization of a color material in a liquid, e.g. an ink, to be imparted onto a recording medium, the improvement of recording quality or chromogenic property, or the improvement of image durability.

Figure 1B:
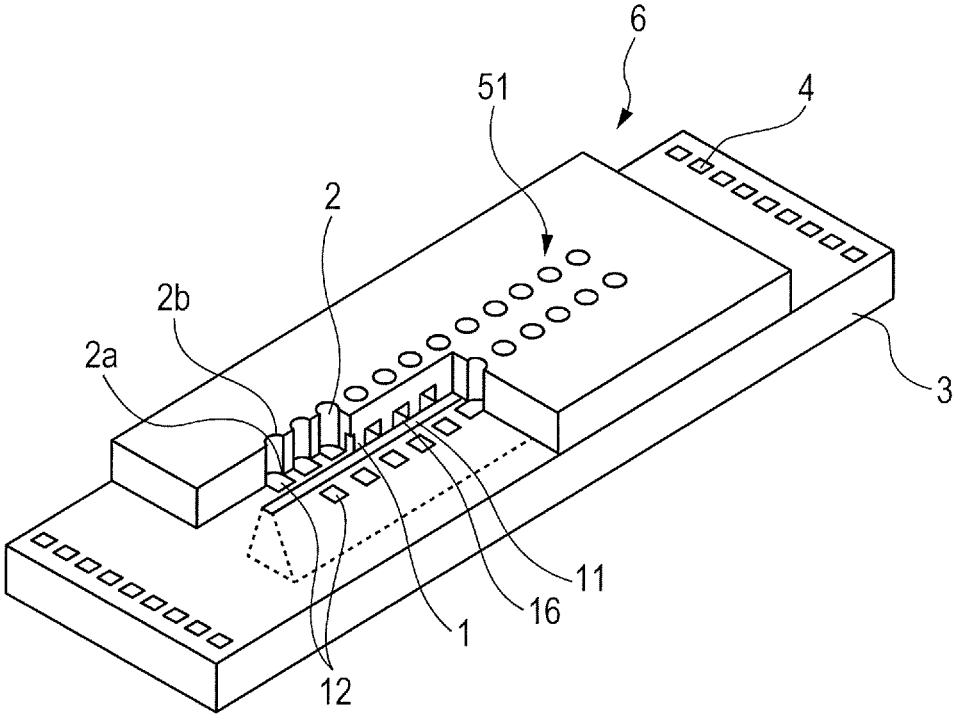

FIGS. 1A and 1B are schematic configuration diagrams of an embodiment of the liquid ejection head in accordance with the present invention; FIG. 1A is a schematic perspective view of the liquid ejection head and FIG. 1B is a schematic perspective view of a recording element substrate provided on the liquid ejection head. For the purpose of easy understanding of the configuration of the inside of the recording element substrate, FIG. 1B omits a part thereof.

A recording element substrate 6 is bonded to a liquid ejection head 5 in accordance with the present invention. Electricity is supplied to the recording element substrate 6 from a contact pad 7 through a flexible wiring substrate 8 to eject a liquid.

The recording element substrate 6 is constituted of a substrate 3, which is provided with a plurality of energy generating elements 12, and an ejection orifice member 1 provided on the substrate 3. The ejection orifice member 1 has a plurality of through-holes, which penetrate in the direction of the width thereof at positions opposing the energy generating elements 12 of the substrate 3. The ejection orifice member 1 is composed of a resin material. The through-holes are simultaneously formed by using a photolithography technique or an etching technique.

The through-holes provided in the ejection orifice member 1 are formed by providing communication between first openings 2*a*, which open at positions opposing the surface of the substrate 3 provided with the energy generating elements 12, and second openings 2*b* provided on the side from which a liquid is ejected. Further, the through-holes are used as ejection orifices 2 through which a liquid is ejected by using the energy generated by the energy generating elements 12. The ejection orifices 2 are linearly arranged at predetermined pitches to form an ejection orifice row 51. FIG. 1A illustrates two ejection orifice rows 51.

As the energy generating elements 12 provided on the substrate 3, electric heat converting elements (heaters) or piezoelectric elements or the like may be used. In the substrate 3, the energy generating elements 12 are provided at the positions opposing the ejection orifices 2, thus forming the energy generating element rows. A liquid supply port 11, which penetrates the substrate 3 and through which a liquid is supplied to the energy generating elements 12, is provided at a position between the energy generating element rows. One or more liquid supply ports 11 may be formed in the substrate 3.

Further, the ejection orifice member 1 and the substrate 3 contacting with each other form a liquid flow path 16, which connects the liquid supply port 11 and the ejection orifices 2. The substrate 3 is further provided with connection terminals 4 for supplying electricity to the energy generating elements 12.

Figure 2A:
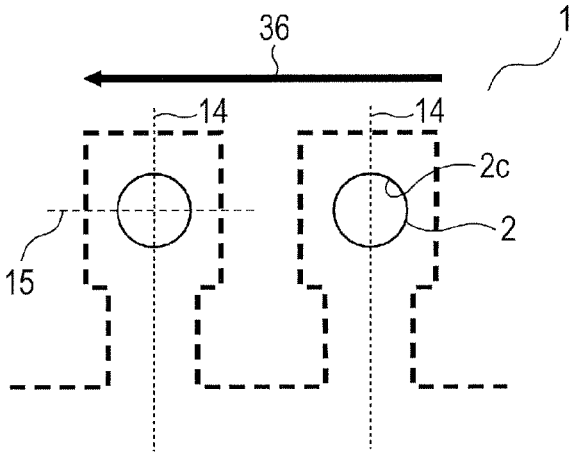
FIGS. 2A, 2B, 2C, 2D and 2E are schematic diagrams illustrating the ejection of a liquid from an ejection orifice fabricated by a conventional method.

FIGS. 2A to 2E present schematic diagrams illustrating how a liquid is ejected through an ejection orifice made by a conventional method. An axis that passes through the center of the ejection orifice 2, orthogonally passes through the ejection orifice 2 relative to the direction of the ejection orifice row, and cuts along the direction of the depth of the ejection orifice 2, as observed from the surface (front surface) of the ejection orifice member 1 in which the ejection orifices 2 are formed, is defined as an X-direction central axis 14. Similarly, an axis that passes through the center of the ejection orifice 2, intersects with the X-direction central axis 14 at 90°, i.e. along an ejection orifice row direction 36, and cuts along the direction of the depth of the ejection orifice 2, is defined as a Y-direction central axis 15 (FIG. 2A). FIG. 2A illustrates the internal structure of the ejection orifice member 1.

Figure 2B:
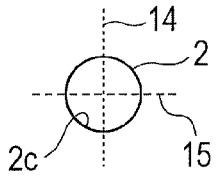
Figure 2C:
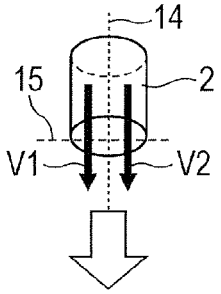
Figure 2D:
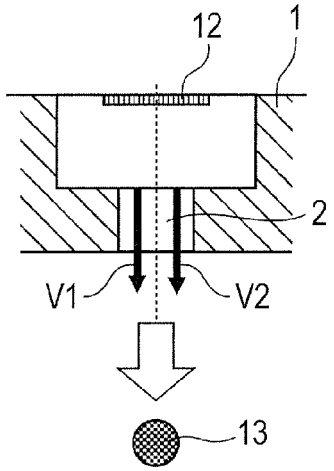
Figure 2E:
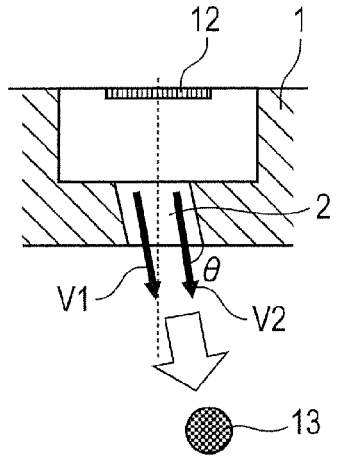

As illustrated in FIG. 2B, the section of the ejection orifice 2 in the radial direction, i.e. the direction that is parallel to the front surface of the ejection orifice member 1, is substantially circular. Hence, if the ejection orifice 2 is divided by the X-direction central axis 14, an area S1 of an inner wall 2*c* on one side (the left side in the drawing) of the ejection orifice 2 and an area S2 of the inner wall 2*c* on the other side (the right side in the drawing) are substantially equal (FIG. 2C). When the liquid is ejected through the ejection orifice member 1, the liquid advances while being in contact with the inner wall 2*c* of the ejection orifice 2, so that a flow resistance occurs as the area of contact between the liquid and the inner wall 2*c* of the ejection orifice 2 (liquid contact area) increases. As illustrated in FIG. 2C, if the area S1 and the area S2 are equal, then the flow resistance against the liquid on one side and the flow resistance against the liquid on the other side, which are separated by the X-direction central axis 14, are substantially equal. Therefore, an ejection velocity v1 on the one side and an ejection velocity v2 on the other side, which sides are separated by the X-direction central axis 14, become equal, causing a droplet 13 to be ejected in a direction along the ejection orifice 2 (FIG. 2D). Thus, if the ejection orifice 2 extends at an angle θ relative to the front surface of the ejection orifice member 1, then the droplet 13 is accordingly ejected at the angle θ relative to the front surface of the ejection orifice member 1 (FIG. 2E).

Meanwhile, if there is a difference between the liquid contact area on the one side and the liquid contact area on the other side when the area in the same ejection orifice 2 is divided at the X-direction central axis 14, then the flow resistances to the ink generated on the one side and the other side will not be equal, preventing the droplet 13 from moving in the direction in which the ejection orifice 2 extends. This means that the direction in which the droplet 13 is ejected can be adjusted by setting the liquid contact areas on the one side and the other side of the ejection orifice 2, which sides are defined by the X-direction central axis 14, to be different from each other.

Figure 3A:
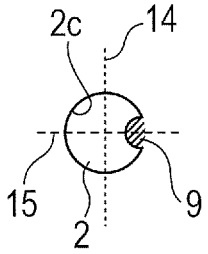
FIGS. 3A, 3B and 3C are schematic configuration diagrams of an ejection orifice in accordance with the present invention.
Figure 3B:
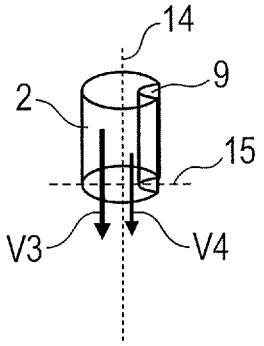
Figure 3C:
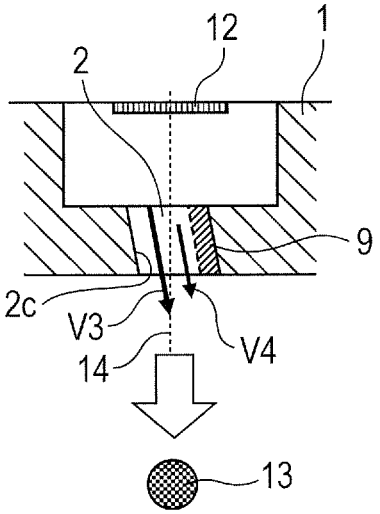

Based on the study described above, the present invention specifies the shape of the ejection orifice 2. FIGS. 3A to 3C present schematic configuration diagrams of the ejection orifice 2 in accordance with the present invention. According to the present invention, in the case where the ejection orifice 2 is divided by the X-direction central axis 14, an ejection angle controlling portion 9 is provided on the inner wall 2*c* of the ejection orifice 2 on the opposite side from the direction in which the liquid is desired to be ejected (FIG. 3A). More specifically, in the present embodiment, the ejection angle controlling portion 9, which juts out from the inner wall 2*c* in the direction of the thickness of the ejection orifice member 1, is provided at a position which is on the other side (the right side in the drawing) obtained when the ejection orifice 2 is divided by the X-direction central axis 14 and which intersects with the Y-direction central axis 15 (FIG. 3B). In other words, the area of the inner wall 2*c* of the ejection orifice 2 is set such that the area on the other side is larger than the area on the one side, the sides being separated by the X-direction central axis 14. This configuration produces a difference in the liquid contact area between the one side and the other side defined by the X-direction central axis 14. As the liquid contact area increases, the flow resistance against the liquid increases, so that an ejection velocity v3 on the one side becomes higher than an ejection velocity v4 on the other side, which sides are separated by the X-direction central axis 14, as illustrated in FIG. 3C. As a result, the liquid is drawn toward the one side having the higher ejection velocity, thus allowing the droplet 13 to be ejected at an angle that is larger than the angle θ.

Figure 4A:
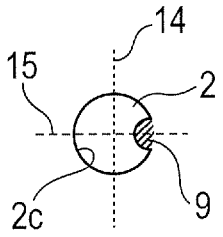
FIGS. 4A, 4B, 4C and 4D are schematic diagrams illustrating a method for controlling the ejection direction of a droplet.
Figure 4B:
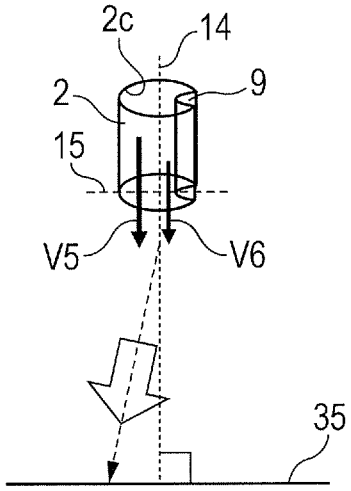
Figure 4C:
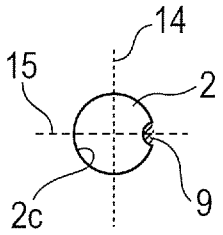

The method for controlling the ejection direction of the droplet 13 will now be described with reference to FIGS. 4A to 4D. The projection amount of the ejection angle controlling portion 9 of a first example illustrated in FIGS. 4A and 4B is set to be larger than that of a second example illustrated in FIGS. 4C and 4D. An area on one side (the left side in the drawing) of the inner wall 2*c* of the ejection orifice 2 relative to the X-direction central axis 14 in the first example and the second example is denoted by S5, and an area on the other side (the right side in the drawing) relative to the X-direction central axis 14 in the first example is denoted by S6. Further, the area on the other side relative to the X-direction central axis 14 in the second example is denoted by S7. In this case, a relationship indicated by S5<S7<S6 holds. This relationship applies also to the liquid contact areas. Thus, if the ejection velocity of the droplet 13 on the one side in the first and the second examples is denoted by V5, the ejection velocity of the droplet 13 on the other side in the first example is denoted by V6, and the ejection velocity of the droplet 13 on the other side in the second example is denoted by V7, then a relationship indicated by V5>V7>V6 holds.

Figure 4D:
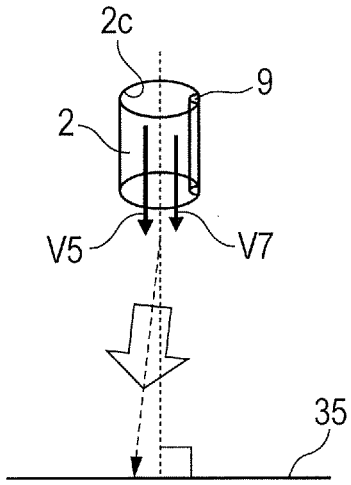

Thus, as illustrated in FIG. 4B and FIG. 4D, the inclination of the ejection direction of the droplet 13 from the vertical direction relative to the recording medium 35 in the first example is larger than the inclination of the ejection direction of the droplet 13 in the second example.

Figure 5:
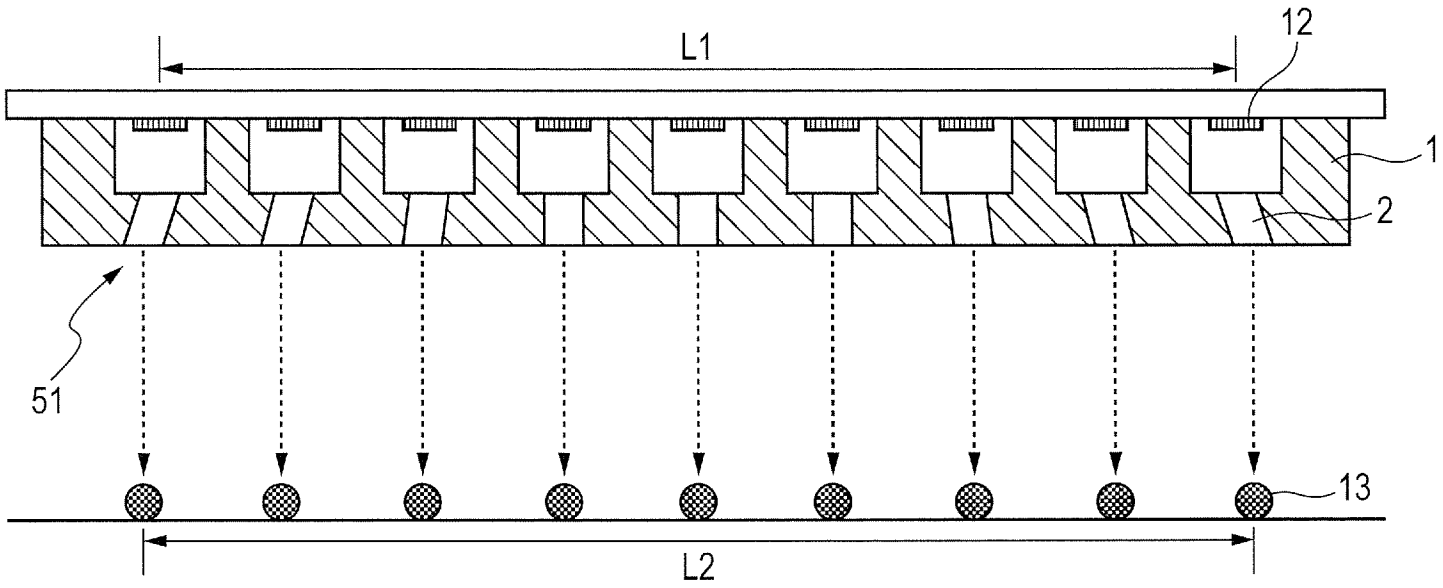
FIG. 5 is a schematic diagram illustrating droplets ejected from the liquid ejection head in accordance with the present invention.

As described above, the ejection angle of the droplet 13 can be adjusted by changing the projection amount of the ejection angle controlling portion 9. Hence, the difference between a distance L1 between the energy generating elements 12 corresponding to the ejection orifices 2 on both ends of the ejection orifice row 51 and a distance L2 between impact points of the droplets 13 ejected from the aforesaid ejection orifices 2 is reduced, as illustrated in FIG. 5, by providing the ejection angle controlling portion 9 having a different size for each ejection orifice 2. In addition, the intervals among the impact points of the droplets 13 ejected from the respective ejection orifices 2 become substantially equal, thus making it possible to restrain the recording quality from deteriorating.

First Embodiment

A first embodiment will be described with reference to FIGS. 6A to 6D. In the basic configuration of the first embodiment, an ejection orifice 2, the section of which in the direction parallel to the front surface of an ejection orifice member 1 is basically circular, has a shape symmetrical relative to an X-direction central axis 14 and a Y-direction central axis 15.

Figure 6A:
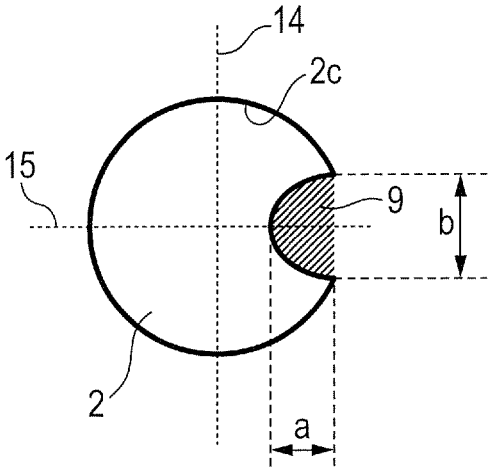
FIGS. 6A, 6B, 6C and 6D are schematic diagrams of a first embodiment of the liquid ejection head.

First, FIG. 6A illustrates a type in which an ejection angle controlling portion 9 is provided at a place on the other side (the right side in the drawing) relative to the X-direction central axis 14 and provided such that the ejection angle controlling portion 9 is symmetrical relative to the Y-direction central axis 15. Imparting a difference in the liquid contact area between one side (the left side in the drawing) and the other side, which sides are separated by the X-direction central axis 14, provides an effect for correcting the ejection angle of a droplet 13, as described above. In order to restrain the deterioration of recording quality attributable to the influence of the shape of the ejection angle controlling portion 9, the ejection angle controlling portion 9 preferably has a section that has a semicircular shape free of any acute angles. Further, the liquid contact area can be changed in steps by changing a height "a" and a width "b" of the ejection angle controlling portion 9, as observed from the front surface of the ejection orifice member 1, thus making it possible to control the ejection angle within a certain range for each ejection orifice. In other words, even if the ejection orifices 2 have different magnitudes of the influences of telecentricity, the droplets 13 can be ejected to desired positions through such ejection orifices 2 by changing the shapes of the ejection orifices 2.

Figure 6B:
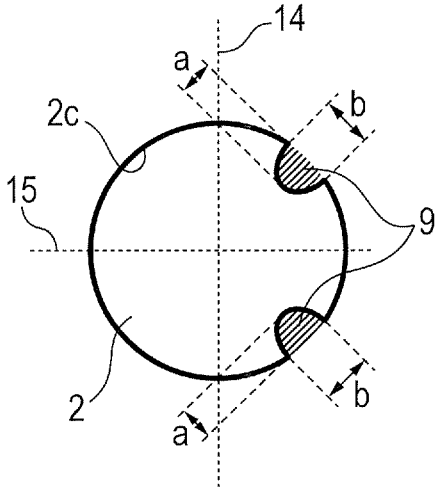
Figure 6C:
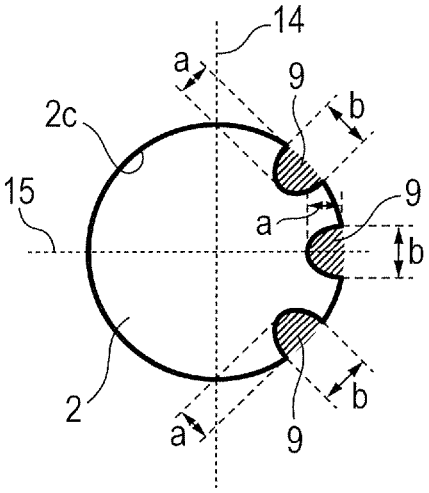

FIG. 6B illustrates a type in which the ejection angle controlling portions 9 are provided at two places which are on the other side relative to the X-direction central axis 14 and which are symmetrical relative to the Y-direction central axis 15. FIG. 6C illustrates a type in which the ejection angle controlling portions 9 are provided at three places which are on the other side relative to the X-direction central axis 14 and which are symmetrical relative to the Y-direction central axis 15. As with the type illustrated in FIG. 6A, these types also have a difference in the liquid contact area between the one side and the other side, which are divided by the X-direction central axis 14, thus permitting the effect for correcting the ejection angles of the droplets. In order to restrain the deterioration of recording quality attributable to the influence of the shape of the ejection angle controlling portion 9, the ejection angle controlling portion 9 preferably has a section that has a semicircular shape free of any acute angles. Further, the liquid contact area can be changed in steps by changing the height "a" and the width "b" of the ejection angle controlling portion 9, as observed from the front surface of the ejection orifice member 1, while maintaining the symmetry relative to the Y-direction central axis 15. Further, installing a plurality of the ejection angle controlling portions 9 provides the effect for controlling the ejection angles and also makes it possible to suppress a reduction in the sectional area of the ejection orifice 2 in the direction parallel to the front surface of the ejection orifice member 1, as compared with that of the type illustrated in FIG. 6A. This arrangement permits lessened restrictions on the sectional area of the ejection orifice in the direction parallel to the front surface of the ejection orifice member 1 attributable to an increased placement density of the ejection orifices 2.

Figure 6D:
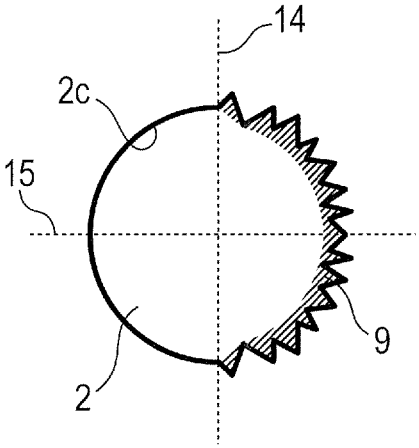

FIG. 6D illustrates a type in which the ejection angle controlling portion 9 is provided with a saw-toothed partial periphery on the other side relative to the X-direction central axis 14 such that the saw-toothed partial periphery is symmetrical relative to the Y-direction central axis 15. In this type also, there is a difference in the liquid contact area between the one side and the other side, which are divided by the X-direction central axis 14, thus providing the effect for correcting the ejection angles of droplets. Further, the liquid contact area can be changed in steps by changing the numbers and the widths of the teeth of the ejection angle controlling portion 9 while maintaining the symmetry relative to the Y-direction central axis 15, so that the ejection angle can be controlled within a certain range. Further, the ejection angle controlling portion 9 having the saw-toothed shape provides the effect for controlling the ejection angles and also makes it possible to suppress a reduction in the sectional area of the ejection orifice 2 in the direction parallel to the front surface of the ejection orifice member 1, as compared with that of the type illustrated in FIG. 6A. This arrangement permits lessened restrictions on the sectional area of the ejection orifice in the direction parallel to the front surface of the ejection orifice member 1 attributable to an increased placement density of the ejection orifices 2.

Figure 7A:
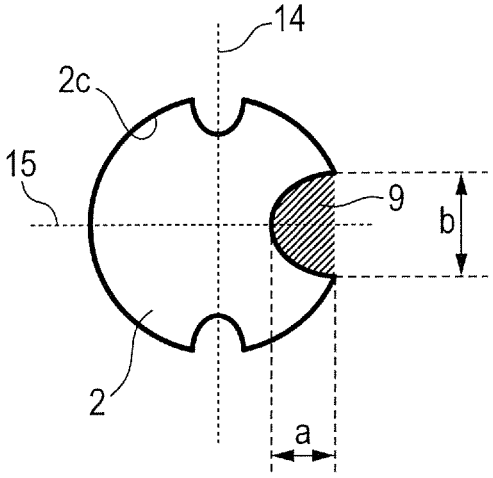
FIGS. 7A and 7B are schematic diagrams of a first embodiment of the liquid ejection head.

A projection may be provided in the ejection orifice 2 for another reason in addition to the purpose of controlling the ejection angle, as in the present embodiment. FIG. 7A illustrates a type in which two projections are provided on the X-direction central axis 14 and the ejection angle controlling portion 9 is provided at one place which is on the other side (the right side in the drawing) relative to the X-direction central axis 14 and which is symmetrical relative to the Y-direction central axis 15. Also in the configuration having the projections in addition the ejection angle controlling portion 9, the ejection angles of droplets can be controlled by providing the ejection angle controlling portion 9.

Figure 7B:
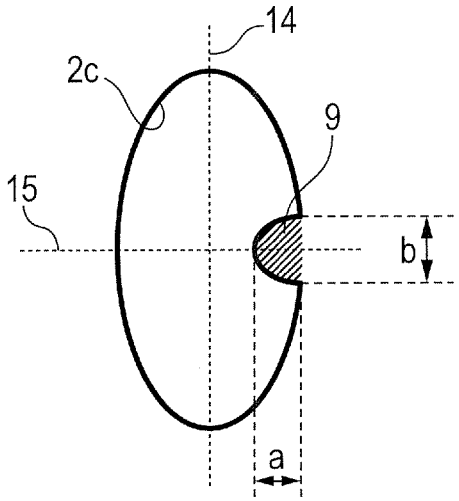

Further, the ejection orifice 2 of the liquid ejection head 5 in accordance with the present invention is not limited to the shape, in which the sectional shape in the radial direction is basically circular. For example, the ejection orifice 2 having an elliptic shape may be used because of restrictions on the placement of the ejection orifice 2. In this case also, the ejection angle of a droplet can be controlled by providing the ejection angle controlling portion 9 at one place which is on the other side relative to the X-direction central axis 14 and which is symmetrical relative to the Y-direction central axis 15, as illustrated in FIG. 7B.

In these configurations also, using a semicircular sectional shape for the ejection angle controlling portion 9 makes it possible to suppress the recording quality from being degraded. Further, the liquid contact area can be changed in steps by changing the height "a" and the width "b" of the ejection angle controlling portion 9, as observed from the front surface of the ejection orifice member 1, thus making it possible to control the ejection angle within a certain range for each ejection orifice. In other words, even if the ejection orifices 2 have different magnitudes of the influences of telecentricity, the droplets can be ejected to desired positions by changing the shapes of the ejection orifices 2. Further, providing a plurality of the ejection angle controlling portions 9 makes it possible to minimize a reduction in the sectional area of the ejection orifice 2 in the direction parallel to the front surface of the ejection orifice member 1. This arrangement permits lessened restrictions on the sectional area of the ejection orifice 2 in the direction parallel to the front surface of the ejection orifice member 1 attributable to an increased placement density of the ejection orifices 2.

(Manufacturing Method)

Figure 8:
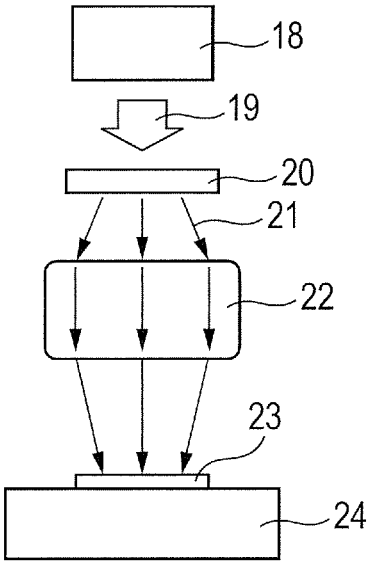
FIG. 8 is a schematic configuration diagram of a reduced projection exposure device.

The method for manufacturing the recording element substrate 6 of the liquid ejection head in accordance with the present invention will now be described. The recording element substrate 6 of the liquid ejection head 5 in accordance with the present invention can be manufactured by using a general reduced projection exposure device. First, the reduced projection exposure device will be described with reference to FIG. 8. In the reduced projection exposure device, a beam 19 emitted from a light source 18 passes through a reticle 20, passes along optical paths 21, in which the beam is spread, and enters a reduced projection optical system 22. The beam 19 out of the reduced projection optical system 22 advances to be focused for exposure on a predetermined region specified by the so-called exposure angle of view on a wafer 23 on an exposure stage 24. Actual exposure is carried out only in a patterned region on the reticle 20 rather than the entire region specified by the exposure angle of view.

A specific description will now be given of the manufacturing method. First, an adhesion layer is deposited on the substrate 3, on which the energy generating elements 12 have been formed, and a fusible positive type photosensitive resin is applied thereon as a mold material by spin coating. Then, a desired pattern is exposed using a mold material exposure mask and developed, thereby forming the mold material for the liquid flow path 16. Subsequently, a negative type photosensitive resin, which will provide the ejection orifice member 1, is applied onto the substrate 3 and the mold material. Subsequently, the pattern of the ejection orifices 2 is exposed using an ejection orifice exposure mask and then subjected to the post exposure bake (PEB) and development, thereby forming the ejection orifices 2. Further, the mold material is removed to form the liquid flow path 16, thus completing the recording element substrate 6 of the liquid ejection head 5.

The shape of the ejection angle controlling portion 9, which characterizes the liquid ejection head 5 according to the present invention, is determined when exposing the pattern of the ejection orifices 2 of the negative type photosensitive resin in the aforesaid manufacturing method. More specifically, the negative type resist exposure mask has a plurality of portions arranged to cover the portions, which become the ejection orifices 2, from exposure. The inner periphery of each of the covered portions is separated into two segments by an axis which passes through the center of the covered portion and which is orthogonal to the row of the covered portions, one segment of the inner periphery being set to be larger than the other segment. A desired configuration of the ejection orifices and the ejection orifice row can be obtained by changing in steps, for each ejection orifice row, the ejection orifice row mask pattern of the negative type resist exposure mask. Thus, the liquid ejection head 5 in accordance with the present invention can be formed merely by changing the mask pattern.

Second Embodiment

A second embodiment of the liquid ejection head in accordance with the present invention will be described with reference to FIGS. 9A and 9B. The second embodiment also has a shape that is symmetrical relative to a Y-direction central axis 15. In the first embodiment, the section of the ejection orifice 2, which is parallel to the front surface of the ejection orifice member 1, is basically circular or elliptic. However, the ejection orifice 2 may have a different basic sectional shape.

Figure 9A:
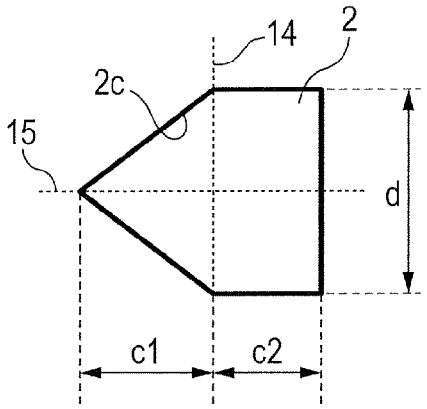
FIGS. 9A and 9B are schematic diagrams of a second embodiment of the liquid ejection head.

An ejection orifice 2 illustrated in FIG. 9A has a triangular portion, which is formed by an X-direction central axis 14 and an inner wall 2*c*, on one side (the left side in the drawing) relative to the X-direction central axis 14, and also has a rectangular portion, which is formed by the X-direction central axis 14 and the inner wall 2*c*, on the other side (the right side in the drawing). In other words, the section of the ejection orifice 2 parallel to the front surface of an ejection orifice member 1 is pentagonal. The effect for controlling the ejection angle of a droplet can be obtained by setting different areas of the inner wall 2*c* for one side and the other side relative to the X-direction central axis 14 so as to provide different liquid contact areas. Further, the liquid contact areas can be changed in steps by changing a length c1 in a Y-direction of the ejection orifice 2 from the X-direction central axis 14 to the end of one side, a length c2 in the Y-direction thereof from the X-direction central axis 14 to the end of the other side, and a length d in the X-direction (the height in the drawing). Thus, the ejection angle can be controlled within a certain range.

Figure 9B:
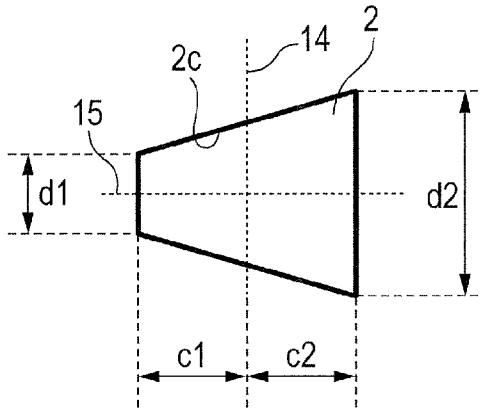

In the ejection orifice 2 illustrated in FIG. 9B, a trapezoidal shape is formed by the X-direction central axis 14 and the inner wall 2*c* on one side relative to the X-direction central axis 14, and another trapezoidal shape, which is larger than that on the one side, is formed by the X-direction central axis 14 and the inner wall 2*c* on the other side. In other words, the ejection orifice 2 is formed such that the section in the direction parallel to the front surface of the ejection orifice member 1 is trapezoidal. The ejection orifice 2 is shaped such that the upper base thereof is positioned on one side, while the lower base thereof is positioned on the other side. Thus, even if the ejection orifice 2 is formed to have significantly different shapes on one side and the other side relative to the X-direction central axis 14, such a polygonal shape, there will be a difference in the area of the inner wall 2*c* between the one side and the other side, i.e. a difference in the liquid contact area, so that the effect for controlling the ejection angle of a droplet can be obtained. Further, the liquid contact area can be changed in steps by changing the length c1 in the Y-direction of the ejection orifice 2 from the X-direction central axis 14 to the end of the one side, the length c2 in the Y-direction thereof from the X-direction central axis 14 to the end of the other side, a length d1 corresponding to the upper base and a length d2 corresponding to the lower base. Thus, the ejection angle can be controlled within a certain range.

Although not illustrated in FIG. 9A and FIG. 9B, the apex at which the inner walls 2*c* intersect with each other may be either pointed or round.

In addition to the embodiments described above, the effect for correcting the droplet ejection angles can be obtained even if the ejection orifice 2 has an extremely irregular sectional shape, such as a star-like sectional shape, as long as there is a difference in the liquid contact area between one side and the other side, which are divided by the X-direction central axis 14.

According to the present invention, the ejection angles of droplets can be adjusted, so that the displacements of droplet impact positions can be suppressed, thus permitting an improved image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-136629, filed Jun. 28, 2013, which is hereby incorporated by reference herein in its entirety.

The invention claimed is:

1. A liquid ejection head comprising:

a recording element substrate which has a plurality of ejection orifices for ejecting a liquid, wherein the plurality of the ejection orifices are arranged to form a row of the ejection orifices, and in at least some of the plurality of the ejection orifices, each having one side and another side, the area of an inner wall of each of the ejection orifices is set to be larger on the other side than on the one side, the one side and the other side being defined by a plane which passes through the center of the ejection orifice, intersects with the row of the ejection orifices at right angles, and extends along the direction of the depth of the ejection orifice.

2. The liquid ejection head according to claim 1, wherein, in at least some of the plurality of the ejection orifices, at least one projection is provided on the other side of the inner wall.

3. The liquid ejection head according to claim 1, wherein the plurality of the ejection orifices are symmetrical relative to an axis which passes through the center of the ejection orifice and which is parallel to the row of the ejection orifices, as observed from a surface of the recording element substrate in which the plurality of the ejection orifices are formed.

4. The liquid ejection head according to claim 1, wherein the one side is a side closer to the center of the row of the ejection orifices and a difference between the area of the inner wall on the one side of the ejection orifice and the area of the inner wall on the other side thereof increases toward an ejection orifice on an end of the row of the ejection orifices from an ejection orifice at the center of the row of the ejection orifices.

5. The liquid ejection head according to claim 1, wherein the section of the ejection orifice in the direction along a front surface of the recording element substrate has a polygonal shape.

6. The liquid ejection head according to claim 1, wherein the ejection orifices open at the surface of an ejection orifice member, deviation of impact positions of a liquid ejected from the ejection orifices caused by telecentricity is controlled by difference between the area of the ejection orifice on the one side and the area of the ejection orifice on the other side.

7. A method for manufacturing a liquid ejection head comprising a recording element substrate which has a row of ejection orifices formed of a plurality of ejection orifices for ejecting a liquid, the method comprising the steps of:

applying a negative type photosensitive resin on the substrate and a mold material; and exposing the negative type photosensitive resin by using a mask in which a plurality of covered portions are arranged to prevent the exposure of the portions that will become the plurality of the ejection orifices, each having one side and another side, and the inner periphery of each of the covered portions is set to be larger on the other side than on the one side, which sides are defined by an axis that passes through the center of the covered portion and orthogonally intersects with the row of the plurality of the covered portions, and carrying out post exposure bake and development thereby to form the row of the ejection orifices.

8. The method for manufacturing a liquid ejection head according to claim 7, wherein the exposure is a reduced projection exposure.

* * * * *